US005980136A

United States Patent [19]

Teumer et al.

[11] Patent Number: 5,980,136

[45] Date of Patent: Nov. 9, 1999

[54] DRUM PLATEN TYPE PRINTING MACHINE FOR PRINTING ON REGULAR AND CARD-STOCK SUBSTRATES

[75] Inventors: Roger G. Teumer, Fairport; George Wittman, Rochester, both of N.Y.

[73] Assignee: Xerox Corporation, Stamford, Conn.

[21] Appl. No.: 09/065,189

[22] Filed: Apr. 23, 1998

[51] Int. Cl.[6] ..... B41J 13/12

[52] U.S. Cl. ..... 400/521; 101/DIG. 43; 347/104; 347/105

[58] Field of Search ..... 347/30, 104, 105, 347/2, 3, 103; 400/521, 522, 523, 524, 533, 538, 541; 101/DIG. 43

[56] References Cited

U.S. PATENT DOCUMENTS

| | | | |
|---|---|---|---|
| 4,129,073 | 12/1978 | Ritzerfeld | 101/2 |
| 4,849,774 | 7/1989 | Endo et al. | 346/140 R |
| 5,561,500 | 10/1996 | Ohzeki et al. | 347/43 |
| 5,581,343 | 12/1996 | Chowdry et al. | 399/45 |
| 5,765,094 | 6/1998 | Nakamura | 399/406 |

FOREIGN PATENT DOCUMENTS

| | | |
|---|---|---|
| 8-197722 | 8/1996 | Japan . |

*Primary Examiner*—Edgar Burr
*Assistant Examiner*—Daniel J. Colilla
*Attorney, Agent, or Firm*—Tallam I. Nguti

[57] ABSTRACT

A printing machine for printing on regular-stock type substrates and on card-stock type substrates includes a rotatable drum member having an outer surface for contacting regular-stock and card-stock type substrates; a first path for moving and printing on regular-stock type substrates, the first path including a curved portion defined by the outer surface of the rotatable drum member, and a first printing station; and a second path for moving and printing on card-stock type substrates, the second path being substantially straight and including a second printing station separate from the first printing station.

8 Claims, 2 Drawing Sheets

DRUM PLATEN TYPE PRINTING MACHINE FOR PRINTING ON REGULAR AND CARD-STOCK SUBSTRATES

BACKGROUND OF THE INVENTION

The present invention relates generally to printing machines or printers including ink jet printers, and more particularly relates to such a printing machine or printer including subassemblies for printing effectively on regular-stock type substrates and heavy card-stock type substrates.

Liquid ink printers of the type frequently referred to either as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. For a drop-on-demand printhead power pulses cause the droplets of ink to be expelled as required from orifices or nozzles at the end of the channels.

In a thermal ink-jet printer, the power pulses are usually produced by formation and growth of vapor bubbles on heating elements or resistors, each located in a respective one of the channels, which are individually addressable to heat and vaporize ink in the channels. As voltage is applied across a selected resistor, a vapor bubble grows in the associated channel and initially expels the ink therein from the channel orifice, thereby forming a droplet moving in a direction away from the channel orifice and towards the recording medium where, upon hitting the recording medium, a dot or spot of ink is deposited. Following collapse of the vapor bubble the channel is refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a supported, stationary recording medium, such as paper or a transparency.

After the swath is printed, the paper is stepped a distance equal to the height of the printed swath or a portion thereof, so that the next printed swath is contiguous or overlapping therewith. This procedure is repeated until an entire page is printed. In contrast, the page width printer includes a stationary printhead having a length sufficient to print across the width or length of a supported sheet of recording medium at a time. The supported recording medium is continually moved past the page width printhead in a direction substantially normal to the printhead length and at a constant or varying speed during the printing process.

In either case, the substrate or sheet is supported and heated on a heating and supporting assembly that includes a platen and a heating device in order to dry the printed swath and prevent it from bleeding into an adjacent swath. Typically, the sheet supporting platen consists of a flat surface, or of a rotating hollow drum, that in either case, has a back surface, and a front surface that has an area which is large enough to support up to a legal size sheet, with border areas left over. In the case of a rotating hollow drum platen for example, heat is generated by a radiant heater or heating device mounted inside the hollow of the drum.

Ordinarily, because drum type printers, such as the ink jet type, have a drum platen having a substantial curvature, they make printing on heavy card-stock difficult, and where possible, tend to induce undesirable curls in heavy card-stock substrates. There is therefore a need for such a printer including subassemblies for enabling effective printing on regular and heavy card-stock substrates.

SUMMARY OF THE INVENTION

In accordance with the present invention, there is provided a printing machine for printing on regular-stock type substrates and on card-stock type substrates includes a rotatable drum member having an outer surface for contacting regular-stock and card-stock type substrates; a first path for moving and printing on regular-stock type substrates, the first path including a curved portion defined by the outer surface of the rotatable drum member, and a first printing station; and a second path for moving and printing on card-stock type substrates, the second path being substantially straight and including a second printing station separate from the first printing station.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
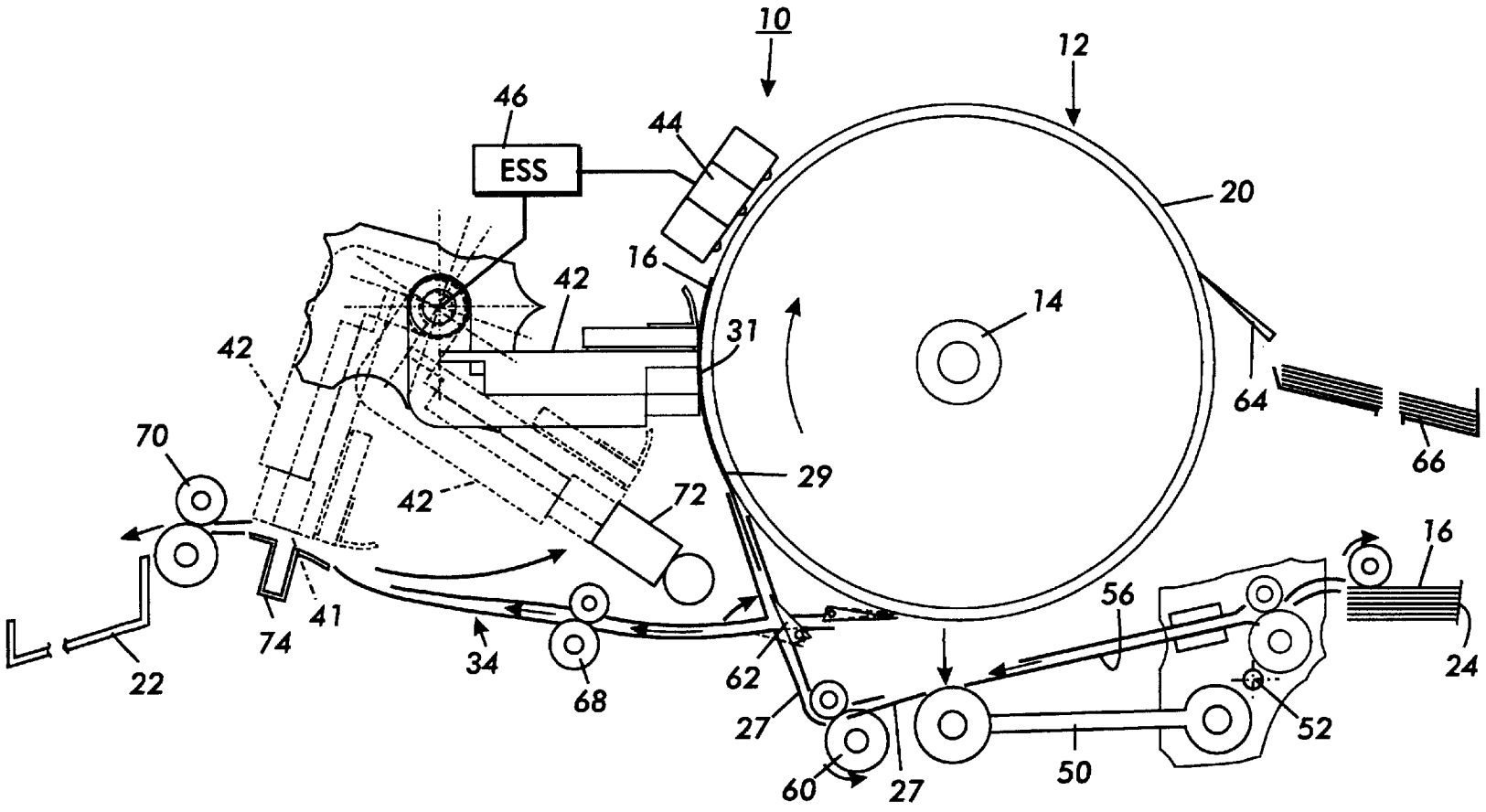
FIG. 1 illustrates a schematic elevational end view of the drum type printing machine of the present invention for printing effectively on regular-stock type substrates and heavy card-stock type substrates, showing subassemblies thereof in position for printing on regular-stock type substrates.
Figure 2:
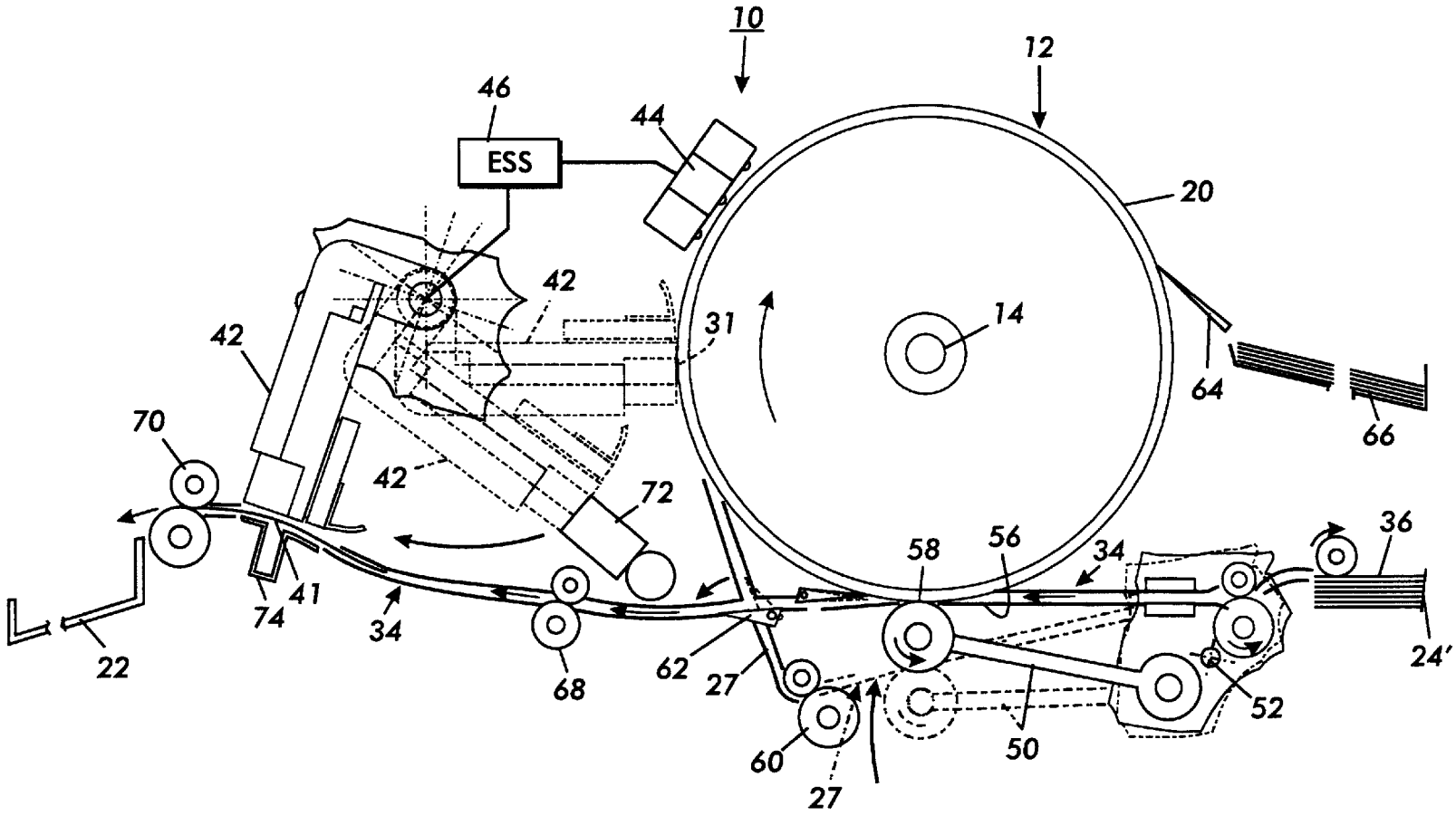
FIG. 2. illustrates the machine of FIG. 1, showing subassemblies thereof in position for printing on card-stock type substrates

Referring now to FIGS. 1–2, a drum type printing machine or printer such as a multicolor ink jet printer is illustrated schematically as 10. The outside covers or case and associated supporting components of the printing machine 10 are omitted for clarity. As shown, printing machine or printer 10 includes a rotatable cylindrical drum 12 for supporting regular-stock type substrates 16 during printing. The rotatable drum member 12 includes a heating device 14 for heating ink images printed on regular-stock type substrates being supported on a curved outer surface 20 of the drum member 12. A regular-stock type substrate 16, such as a 20# sheet of paper or a transparency when fed to the drum 12, is placed over the outer surface 20 of the drum 12, with at least its leading edge attached to the surface 20.

Typically, the sheet is attached to the drum 12 either by the application of a vacuum through holes in the drum 12 (not shown), or by other means of holding the sheet to the drum, for example, electrostatic means. In operation, as the drum 12 with a regular-stock type substrate 16 attached thereto rotates, it moves the regular-stock type substrate 16 with it. As further shown, the printing machine 10 includes an output tray 22 for receiving printed substrates, and an input source 24 for holding and supplying either regular-stock type substrates or card-stock type substrates.

Importantly, in accordance with the present invention, as shown in FIG. 1, the printing machine 10 includes a first path 27 for moving regular-stock type substrates 16. The first path 27 includes a curved portion 29 and a first printing station 31. The curved portion 29 is defined by the outer surface 20 the rotatable drum member 12, and the printing station 31 lies along the first path 27, and within the curved portion 29, as shown.

Importantly too, as shown in FIG. 2, the printing machine 10 also includes a second path 34 for moving card-stock type substrates 36. The second path 34 is substantially straight and includes a second printing station 41 that is separate and different from the first printing station 31. Preferably, the second printing station 41 is located about 900 from the first printing station 31. The substantially straight second path 34 thus defines an alternate, and relatively straight substrate path for enabling effective quality printing, for example, on heavy card-stock type substrates 36, such as envelopes and cover stock.

The printing machine 10 of the present invention preferably includes a pivotably mounted printhead 42 having a first position (FIG. 1) for printing on regular-stock type substrates 16 at the first printing station 31, and a second position (FIG. 2) for printing on card-stock type substrates 36 at the second printing station 41. As further shown, the printing machine 10 may also include another printhead 44 for additionally printing on regular-stock substrates being supported on the surface 20.

As is well known, the printheads 42, 44 can be formed of several partial width arrays that are each filled or charged with printing ink of the same or different colors and that are butted together. Each of the printheads 42 and 44 includes several hundred or more channels and nozzles which in operation can be fired sequentially. In operation, a partial width array when charged or filled with ink, can be moved from one edge to another of the substrate 16 for printing on the substrate. When filled with ink, the partial width arrays respectively, will each contain ink of one of the colors, for example, cyan, magenta or yellow, for color printing. Another partial width array, or the pivotable printhead 42, will thus contain black ink, especially when needed for printing graphics.

In accordance with the present invention, the pivotable printhead 42 is preferably a full-width array or pagewidth printhead that is filled or charged with black printing ink. The printhead 42 thus has a length that is sufficient for printing across the entire width (or length) of a substrate during a single pass of the substrate beneath the printhead.

In each case, a front or forward facing edge of each printheads 42, 44 contains liquid droplet ejecting orifices or nozzles which can in operation, eject ink droplets along a trajectory which is substantially perpendicular to the surface of a substrate on which it is printing. As is well known, each printhead contains heating elements and printed wiring boards (not shown). The printed wiring boards contain circuitry required to interface and cause the individual heating elements in the printhead units to eject liquid (e.g. ink) droplets from the nozzles. The data required to drive the individual heating elements is supplied through a standard printer interface (not shown), that is modified and/or buffered, for example, an electronic control subsystem (ESS) 46 that also controls other aspects and functions of the printing machine 10.

As further shown in FIGS. 1 and 2, the printing machine 10 of the present invention includes an articulating pinch roll member 50 that is pivotable about a pivot 52, for example. The pinch roll member 50 thus has a first position (FIG.2) where it forms a drive nip 54 with the outer surface 20 of the rotatable drum member 12 for driving and moving card-stock type substrates 36 through to the second printing station 41. Note that the input source 24 when loaded with heavy card-stock type substrates, is shown as 24' (FIG. 2). A pivotable baffle assembly 56 is preferably mounted commonly with the pinch roll member 50, and selectively forms a portion of the first path 27 (FIG. 1) when the pinch roll member 50 is spaced from the rotatable drum 12. The pivotable baffle assembly 56 also selectively forms a portion of the second path 34 (FIG. 2) when the pinch roll member 50 is in driving nip contact with the rotatable drum 12. Appropriate openings are provided through plates forming the baffle assembly 50 in order to allow such driving nip contact.

The printing machine 10 as shown also includes a precurling device 60 that forms part of the first path 27, and is positioned upstream of the curved portion 29, relative to a direction of substrate movement, for inducing a curl into a regular-stock substrate to be supported on the curved surface 20 along the first path.

In operation, as shown in FIG. 1, a regular-stock type substrate 16 is fed from the source 24 along the baffle assembly 56 as shown in FIG. 1 (inclined at angle with the pinch roll member spaced from the drum 12) into the precurler 60. From the precurler 60, the regular-stock substrate is fed upwards through a gate 62 into supporting contact on the outer surface 20 of the drum 12. The printhead 42 is in its first position as shown for printing black liquid ink images, for example, onto the substrate 16 at the first printing station 31 on the drum 12. Additional printing, for example, using cyan, magenta and yellow inks can be achieved using the second printhead 44. The substrate 16 as supported on the surface 20 during such printing is being heated, and the ink images printed thereon being dried, by heat from the heating device 14. The printed regular-stock substrate is thereafter separated from the surface 20, for example by a skive member 64, and directed to a second output tray 66. The printed regular-stock substrate can also be directed to output tray 22, by being moved with the surface 20, and through the gate 62. The position of the printhead 42 and the rest of the functions and aspects of the machine 10 are controlled by means of an electronic control subsystem (ESS) 46.

Alternatively, as shown in FIG. 2, a heavy card-stock type substrate 36 is fed from the source 24' along the baffle assembly 56 as shown in FIG. 2 (in the substantially horizontal and straight orientation with the pinch roll member in nip contact with the drum 12) into contact within a nip 58 with the outer surface 20 of the drum 12. The substrate 36 is then fed through the gate 62, and in a substantially horizontal direction, for example through substrate advancing nip rolls 68, through the second printing station 41, and into edge grip feed rolls 70. The printhead 42 as shown is in its second position for printing black liquid ink images, for example, onto the substrate 36 at the second printing station 41. The printed card-stock substrate 36 is thereafter fed by the edge-grip feed rolls 70, and directed to the first output tray 22. The edge grip feed rolls may comprise star wheels on the printed side of the substrate in order to avoid image offset. Drying may be enhanced by providing a heating element (not shown) between the second printing station 41 and the exit nip or by reducing the printing speed. The position of the printhead 42 and the rest of the functions and aspects of the machine 10 during such feeding and printing are controlled by means of the electronic control subsystem (ESS) 46.

Still referring to FIGS. 1 and 2, the printing machine 10 further includes a maintenance station comprising a capping member 72 for capping the printhead 42 during idle periods of the printhead and a gutter member 74 for receiving waste ink that is purged from the printhead between succeeding substrates, for example.

To recapitulate, there has been provided a drum type printing machine which utilizes an existing paper path that includes a precurler and a curved portion defined by contact with the outer surface of a heated drum for handling regular-stock substrates. It also provides an alternative, bypass straight transport path that includes a contact nip with the outer surface of the drum for handling heavy, card-stock type substrates. The machine utilizes the drum to drive the different stock type substrates while preheating the printing surface of through contact with the surface of the heated drum.

It is understood that an alternate scheme is possible where the printhead capping position and envelope printing position of the printhead are the same. The capping mechanism, gutter and exit nip are instead mounted on a common frame (not shown) which rotates into the desired location. In the capped position, the cap member can be cammed against the printhead when not in use. During card-stock type substrate printing, the cap member is cammed down and the gutter and the exit nip rotated to allow for printing. As can be seen, there has been provided in accordance with the present invention, a printing machine for printing on regular-stock type substrates and on card-stock type substrates which includes a rotatable drum member having an outer surface for contacting regular-stock and card-stock type substrates; a first path for moving and printing on regular-stock type substrates, the first path including a curved portion defined by the outer surface of the rotatable drum member, and a first printing station; and a second path for moving and printing on card-stock type substrates, the second path being substantially straight and including a second printing station separate from the first printing station.

While the present invention has been described with reference to a preferred embodiment, it will be appreciated from this teaching that within the spirit of the present invention, various alternative modifications, variations or improvements therein may be made by those skilled in the art.

What is claimed is:

1. A printing machine for printing on regular-stock type substrates and on card-stock type substrates, the printing machine comprising:

(a) a rotatable drum member having an outer surface for contacting regular-stock and card-stock type substrates;

(b) a first path for moving regular-stock type substrates, said first path including a curved portion and a first printing station, said outer surface of said rotatable drum member defining said curved portion; and c) a second path alternate to said first path, for moving card-stock type substrates, said second path being substantially straight and including a second printing station separate from said first printing station.

2. The printing machine of claim 1, including a single printhead having a first position for printing on regular-stock type substrates at said first printing station, and a second position for printing on card-stock type substrates at said second printing station.

3. The printing machine of claim 1, including an articulating pinch roll member having a first position forming a drive nip with said outer surface of said rotatable drum member for driving and moving card-stock type substrates through to said second printing station.

4. The printing machine of claim 2, including a maintenance station having a capping member for capping said printhead during idle periods of said printhead and a gutter member for receiving waste ink purged from said printhead between substrates.

5. The printing machine of claim 2, wherein said second printing station is located about 902 from said first printing station.

6. The printing machine of claim 2, wherein said first path includes a precurling device positioned upstream of said curved portion of said first path, relative to a direction of substrate movement along said first path.

7. The printing machine of claim 4, including a post printing heating device located downstream of said second printing position for heating ink images printed on substrates.

8. The printing machine of claim 4, wherein said rotatable drum member includes a heating device for heating ink images printed on regular-stock type substrates being supported along said first path on said curved surface of said drum member.

* * * * *